US008622941B2

(12) United States Patent
Wu

(10) Patent No.: US 8,622,941 B2
(45) Date of Patent: Jan. 7, 2014

(54) HAND-HELD MASSAGE DEVICE

(75) Inventor: Dong-Her Wu, Puyen Hsiang (TW)

(73) Assignee: Twinsonic Enterprise Co., Ltd., Chang-Hua Hsien (TW)

( * ) Notice: Subject to any disclaimer, the term of this patent is extended or adjusted under 35 U.S.C. 154(b) by 331 days.

(21) Appl. No.: 13/204,712

(22) Filed: Aug. 7, 2011

(65) Prior Publication Data

US 2013/0035616 A1 Feb. 7, 2013

(51) Int. Cl.
*A61H 1/00* (2006.01)
*A61H 7/00* (2006.01)

(52) U.S. Cl.
USPC ..... 601/68; 601/6; 601/46; 601/67; 601/84; 601/85; 601/112

(58) Field of Classification Search
USPC ..... 601/46, 67, 68, 84, 85, 112, 6
See application file for complete search history.

(56) References Cited

U.S. PATENT DOCUMENTS

| | | | | |
|---|---|---|---|---|
| 7,261,699 | B1 * | 8/2007 | Wu | 601/72 |
| 7,294,113 | B1 * | 11/2007 | Wu | 601/70 |
| 2007/0185420 | A1 * | 8/2007 | Nan | 601/72 |
| 2008/0004553 | A1 * | 1/2008 | Tsai | 601/120 |
| 2010/0160841 | A1 * | 6/2010 | Wu | 601/135 |
| 2010/0312156 | A1 * | 12/2010 | Wu | 601/112 |
| 2011/0034763 | A1 * | 2/2011 | Domnick et al. | 600/38 |
| 2012/0053496 | A1 * | 3/2012 | Wu | 601/97 |
| 2012/0053497 | A1 * | 3/2012 | Wu | 601/97 |
| 2012/0232444 | A1 * | 9/2012 | Chen | 601/107 |
| 2013/0131562 | A1 * | 5/2013 | Wu | 601/112 |

* cited by examiner

*Primary Examiner* — Clinton T Ostrup

(57) ABSTRACT

A hand-held massage device comprises: a control handle, a first engaging member, a second engaging member, a gripping section, a casing, a rotation disk and a massage member. The massage device requires no electricity and has a convenient size, which is highly portable for the user.

9 Claims, 9 Drawing Sheets

HAND-HELD MASSAGE DEVICE

BACKGROUND OF THE INVENTION

1. Field of the Invention

The present invention relates to a hand-held massage device, and more particularly to a massage device that requires no electricity.

2. Description of the Related Art

Modern living is causing more and more people to suffer from high stress. A massage is one of the more common relaxation methods, which can help induce relaxation and rest. However, a massage service requires making an appointment and traveling to the appointment, which is also costly. Therefore, massage mechanisms are also very popular relaxation products.

But, most hand-held massage devices require electric power and have complicated structures and are relatively heavy. Furthermore, most hand-held massage devices can only provide beating and rolling movements to the body, which may cause damage or injury to the body due to poor strength control, and such types of massage devices are not suitable for the head or face areas.

Therefore, it is desirable to provide a hand-held massage device to mitigate and/or obviate the aforementioned problems.

SUMMARY OF THE INVENTION

An objective of the present invention is to provide a hand-held massage device.

In order to achieve the above-mentioned objective, a hand-held massage device comprises: a control handle, a first engaging member, a second engaging member, a gripping section, a casing, a rotation disk and a massage member. The control handle is an extended hollow rod providing a containment space for the first engaging member. One end of the control handle has an enlarged portion and another end is capable of accepting the second engaging member. The first engaging member is a screw rod and has a spiral slot around a periphery of the screw rod and a sleeve respectively extending from both ends. The second engaging member has a threaded hole with a spiral slot, the threaded hole engaging with the screw rod of the first engaging member when the second engaging member is secured onto the control handle. The gripping section is a hollow tube and has an inner diameter substantially equal to an outer diameter of the control handle and the second engaging member, such that the control handle is capable of being disposed in the gripping section and sliding inside of the gripping section. The casing is installed onto another end of the gripping section opposite the end accepting the control handle, and has a first bearing containment space for accepting a first bearing at a central position on a front side. The first bearing containment space has a through aperture for allowing the sleeve of the first engaging member to be connected to the rotation disk. The rotation disk has a socket at a central position on a side for accepting and securing the sleeve, a second bearing containment space formed at an eccentric position on another side, and after a second bearing is placed in the second bearing containment space, a cover is placed to close the space. The second bearing containment space further has a through hole. The massage member is cup-shaped. A raised portion is formed at a central position of an end. The raised portion further has a securing knob placed through the cover and screwed with a corresponding screw at an end adjacent to the through hole, such that the raised portion of the massage member is secured onto the cover. A flange is inwardly formed at an open end of the massage member. The flange provides a curved and smooth massage surface and a predetermined space is formed between the massage surface and a bottom of the massage member.

With the above-mentioned structure, the following benefits can be obtained: 1. The massage device requires no electricity and has a convenient size, which is highly portable for the user. 2. The massage device only affects the surface of the skin, which can avoid causing any damage or injury to the body, and the material of the massage member is suitable for use on the facial area or the area of the head or any other fragile area of the human body. 3. The movements of the hands also serves as hand exercises for the user. 4. Since the massage member is made of silicon, the massage surface can have a complete contact surface with the skin of the body area, which can prevent painful feelings caused by the liner contact. 5. The massage device provides a large contact surface, which can improve the massage effect.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
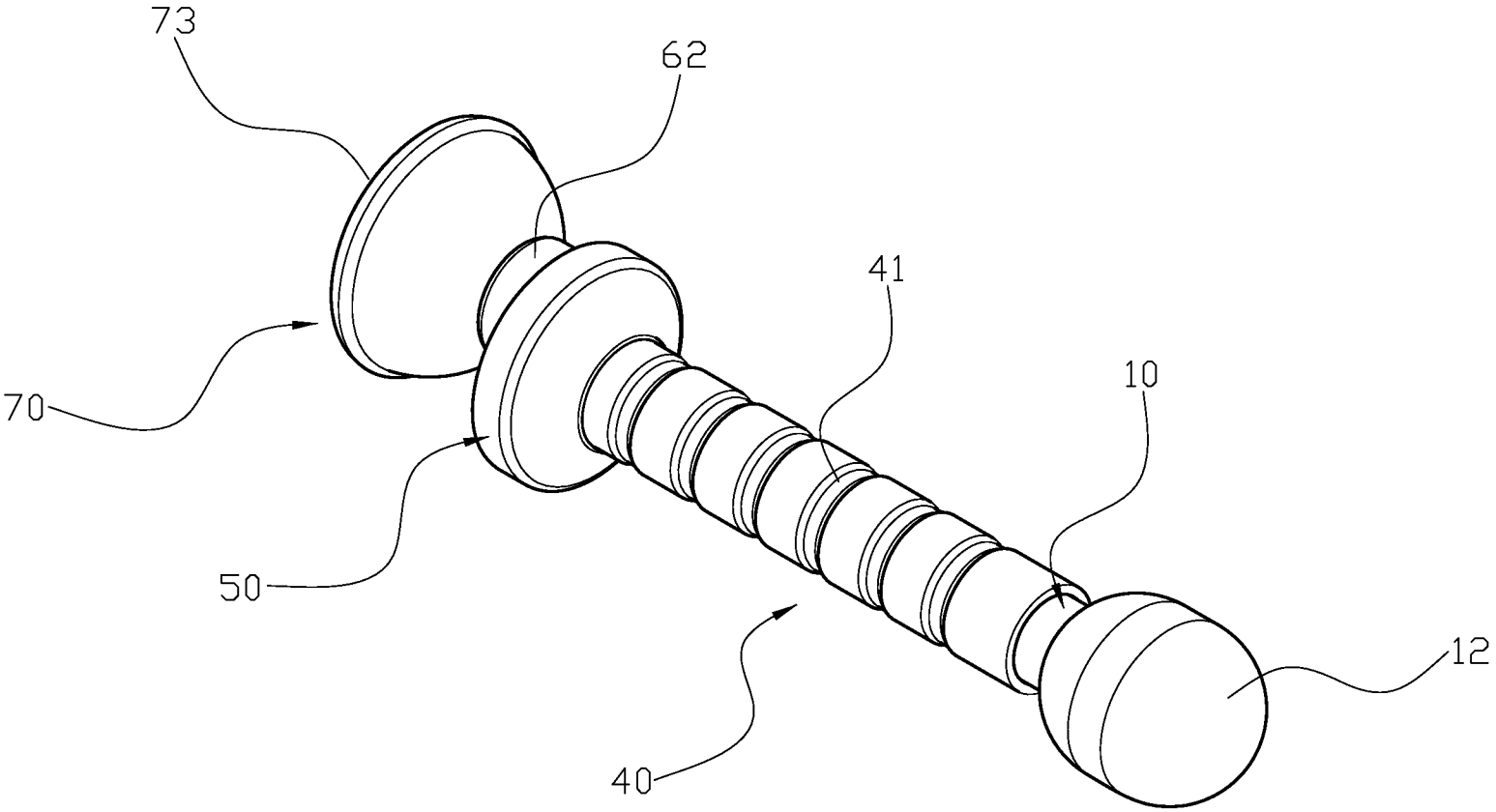
FIG. 1 is a perspective view of a preferred embodiment of the present invention.
Figure 2:
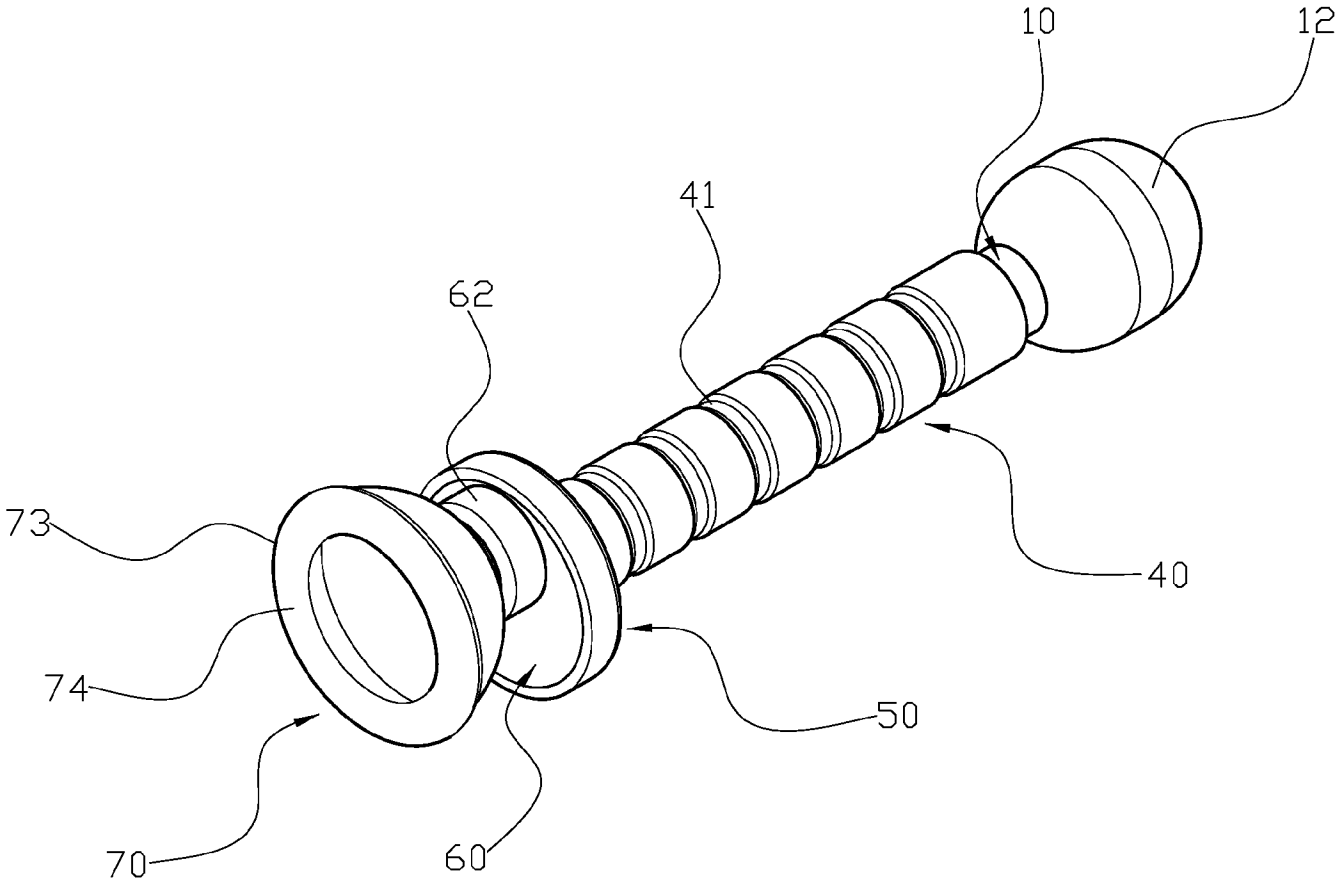
FIG. 2 is another perspective view of the preferred embodiment of the present invention
Figure 3:
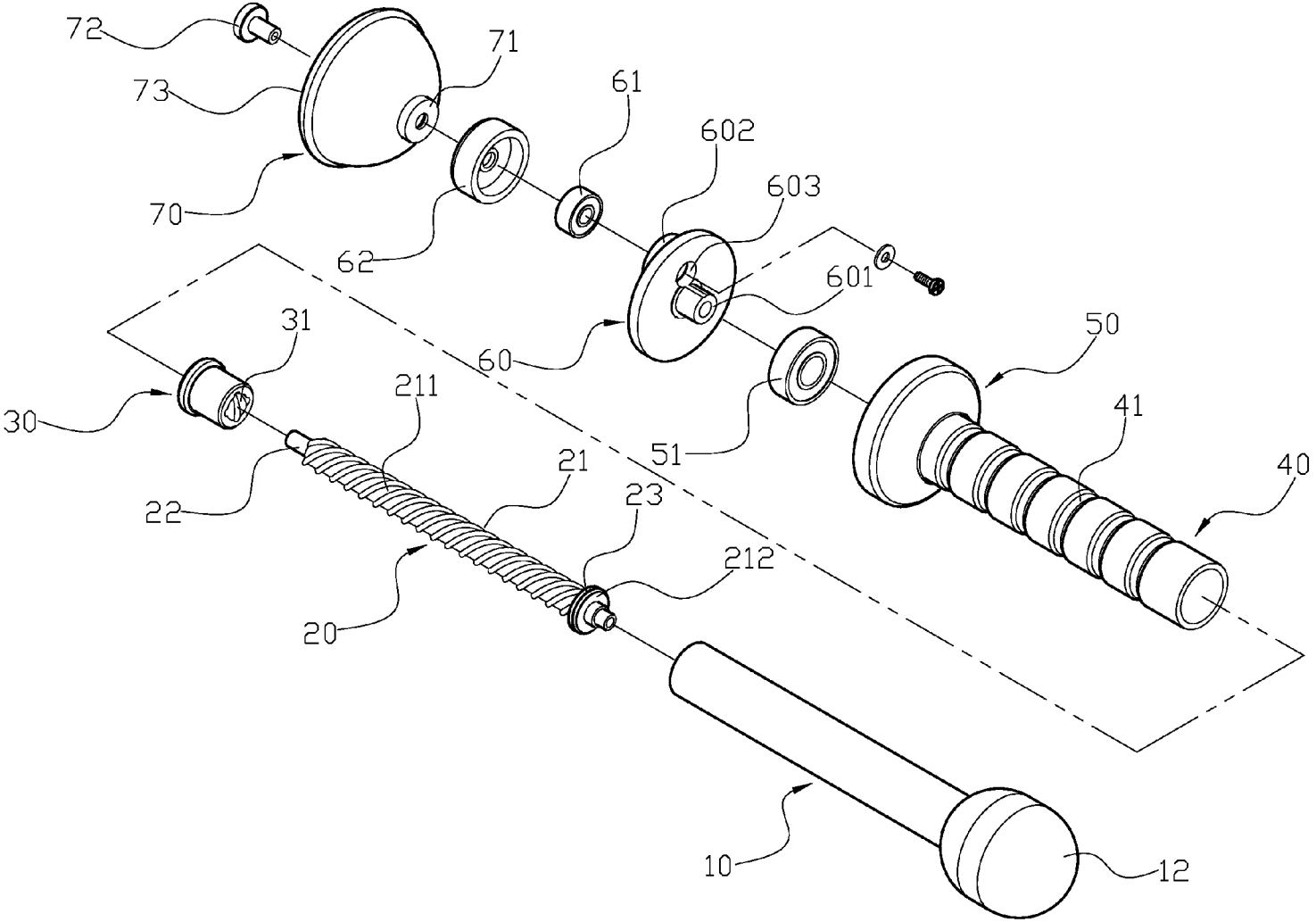
FIG. 3 is a perspective exploded view of the preferred embodiment of the present invention.
Figure 4:
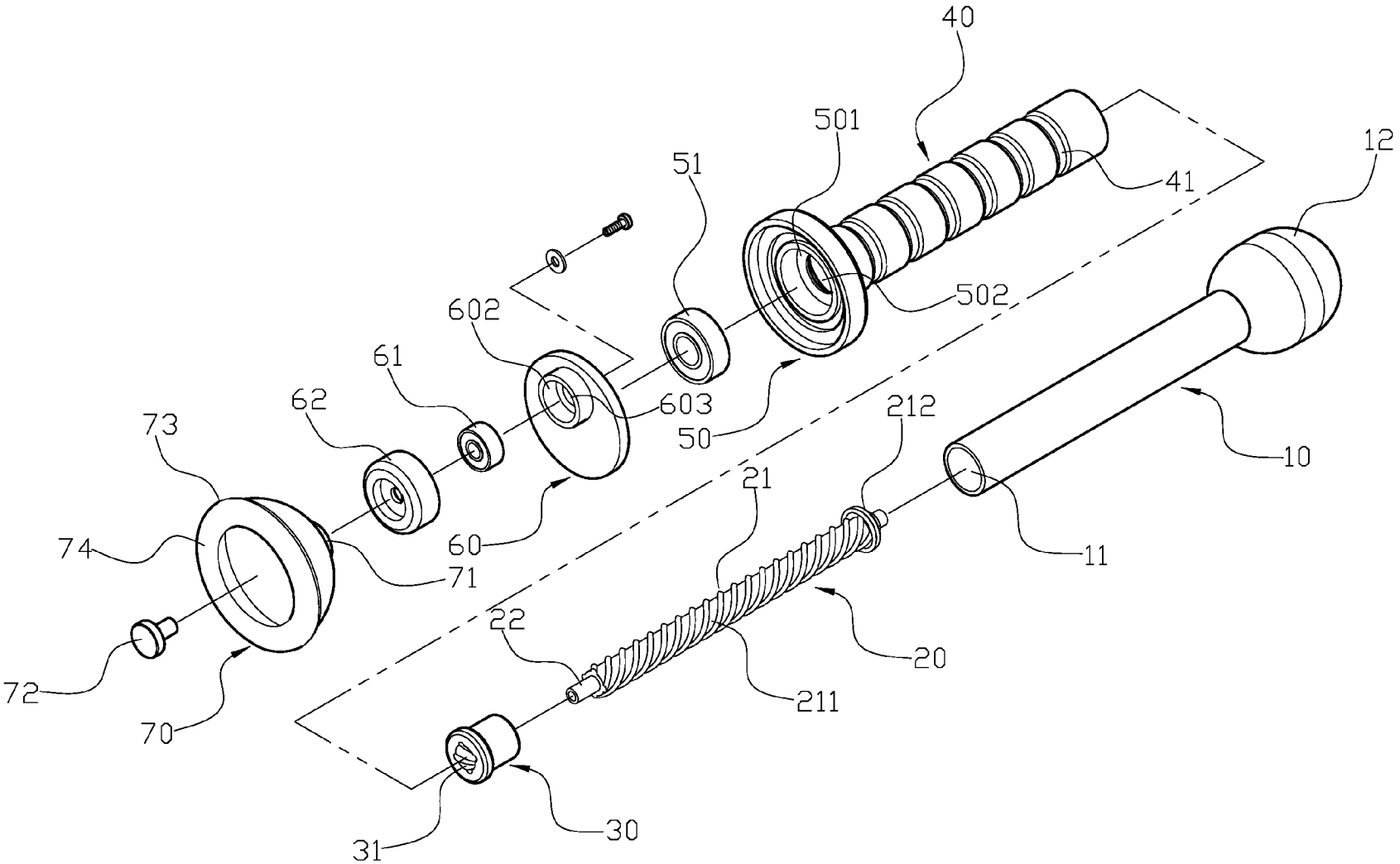
FIG. 4 is another perspective exploded view of the preferred embodiment of the present invention.
Figure 5:
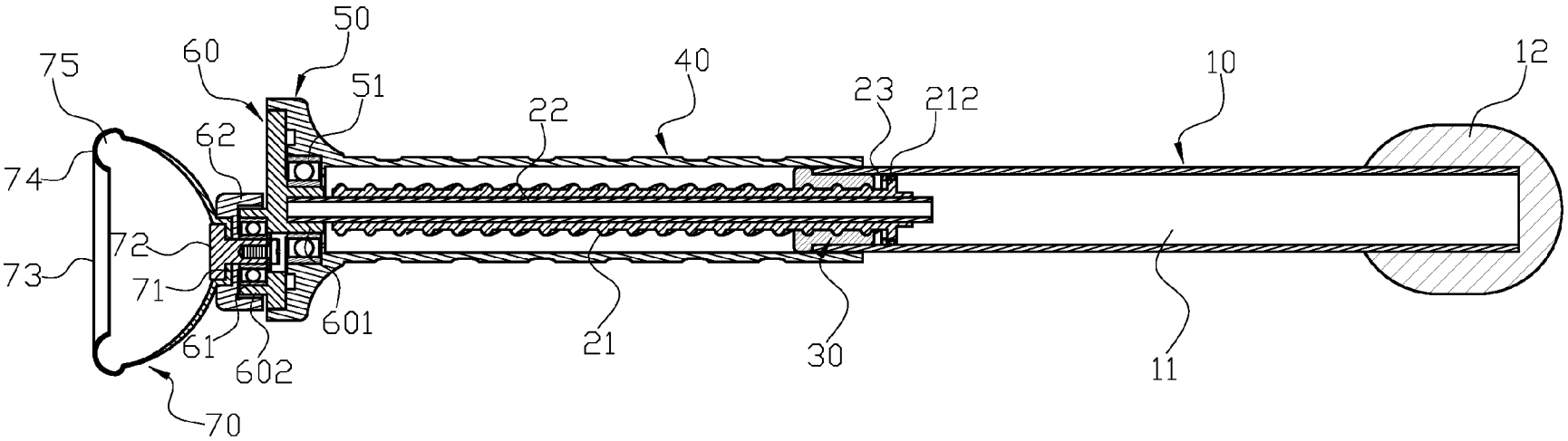
FIG. 5 is a cross-sectional view of the preferred embodiment of the present invention.

First, please refer to FIG. 1 to FIG. 5. The hand-held massage device comprises a control handle 10, a first engaging member 20, a second engaging member 30, a gripping section 40, a casing 50, a rotation disk 60 and a massage member 70. The control handle 10 is an extended hollow rod providing a containment space 11 for the first engaging member 20; one end of the control handle 10 has an enlarged portion 12 and another end is capable of accepting the second engaging member 30. The first engaging member 20 has a screw rod 21 made of plastic and has a spiral slot 211 around a periphery of the screw rod 21 with a metal sleeve 22 respectively extending from both ends of the screw rod 21. The screw rod 21 is formed by injection covering the sleeves 22, such that the first engaging member 20 can provide a higher strength at a lower manufacturing cost. A raised edge 212 is formed at a rear end of the screw rod 21. The raised edge 212 is jacketed with a ring. When the rear end of the first engaging member 20 is placed into the control handle 10; the raised edge 212 and the ring both push against an inner wall of the containment space 11 for support purposes. The second engaging member 30 and the control handle 10 can be formed separately or integrally. The second engaging member 30 has a threaded hole 31 with a spiral slot; the threaded hole 31 engages with the screw rod 21 of the first engaging member 20 when the second engaging member 30 is secured onto the control handle 10. The gripping section 40 is a hollow tube and has an inner diameter substantially equal to the outer diameter of the control handle 10 and the second engaging member 30, such that the control handle 10 is capable of being disposed in the gripping section 40 and sliding inside of the gripping section 40. The gripping section 40 further has a plurality of anti-slip slots 41. The casing 50 is installed onto another end of the gripping section 40 opposite the end accepting the control handle 10, and has a first bearing containment space 501 for accepting a first bearing 51 at a central position on a front side. The first bearing containment space 501 has a through aperture 502 for allowing the sleeve 22 of the first engaging member 20 to be connected to the rotation disk 60. The rotation disk 60 has a socket 601 at a central position on a side for accepting and securing the sleeve 22. A second bearing containment space 602 is formed at an eccentric position on another side of the rotation disk 60, and after a second bearing 61 is placed in the second bearing containment space 602, a cover 62 is placed to close the space. The second bearing containment space 602 further has a through hole 603. The massage member 70 is cup-shaped and made of silicon. A raised portion 71 is formed at a central position of one end; the raised portion 71 further has a securing knob 72. The securing knob 72 and the massage member 70 are formed integrally as shown in FIG. 9 or separately as shown in FIG. 3, FIG. 4 FIG. 5 and FIG. 8. The securing knob 72 is placed through the cover 62 and secured with a corresponding screw at an end adjacent to the through hole 603, such that the raised portion 71 of the massage member 70 is secured onto the cover 62. A flange 73 is inwardly formed at an open end of the massage member 70; the flange 73 provides a curved and smooth massage surface 74 and a predetermined space 75 is formed between the massage surface 74 and a bottom of the massage member 70.

Figure 6:
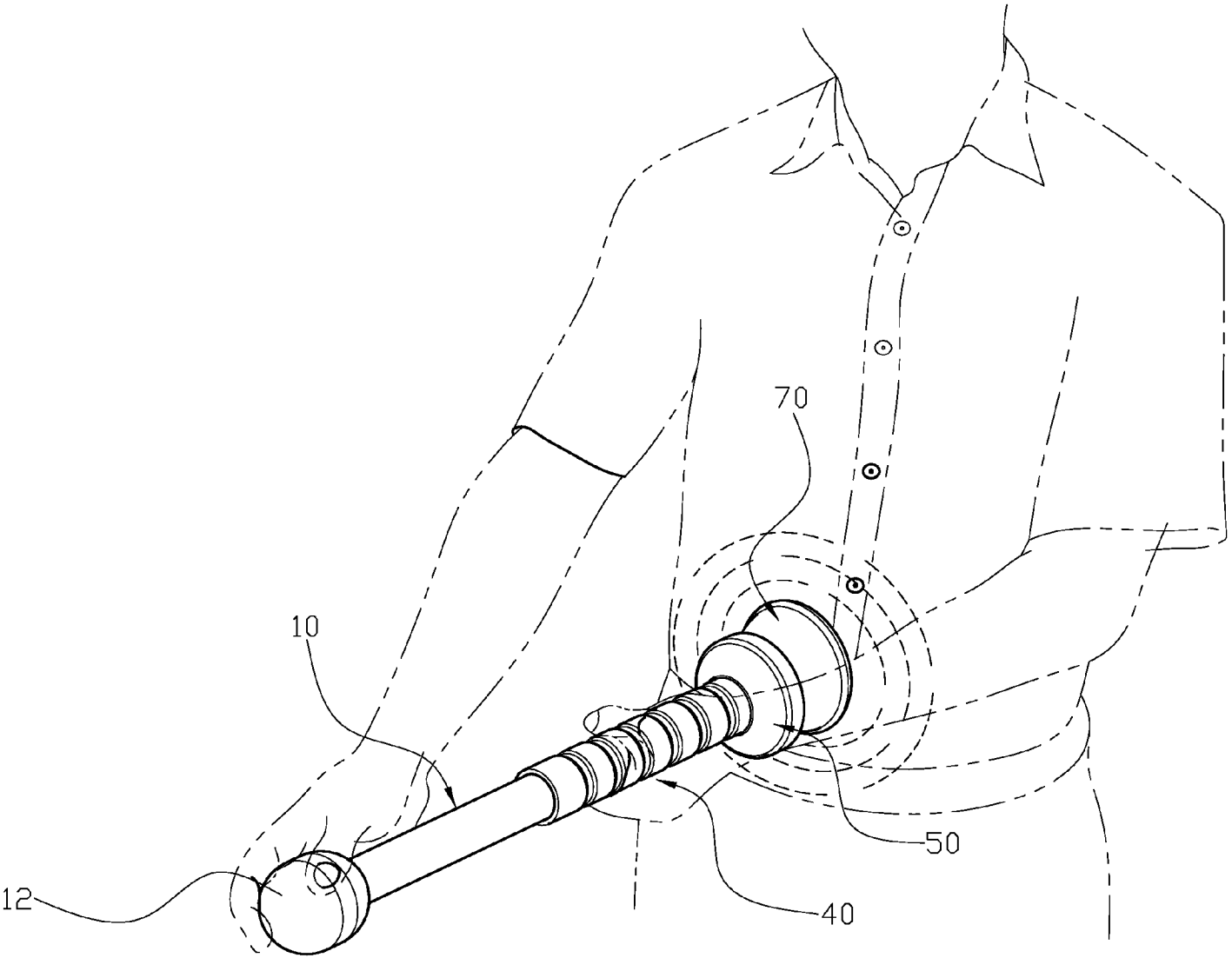
FIG. 6 is a schematic drawing of the preferred embodiment of the present invention.
Figure 7:
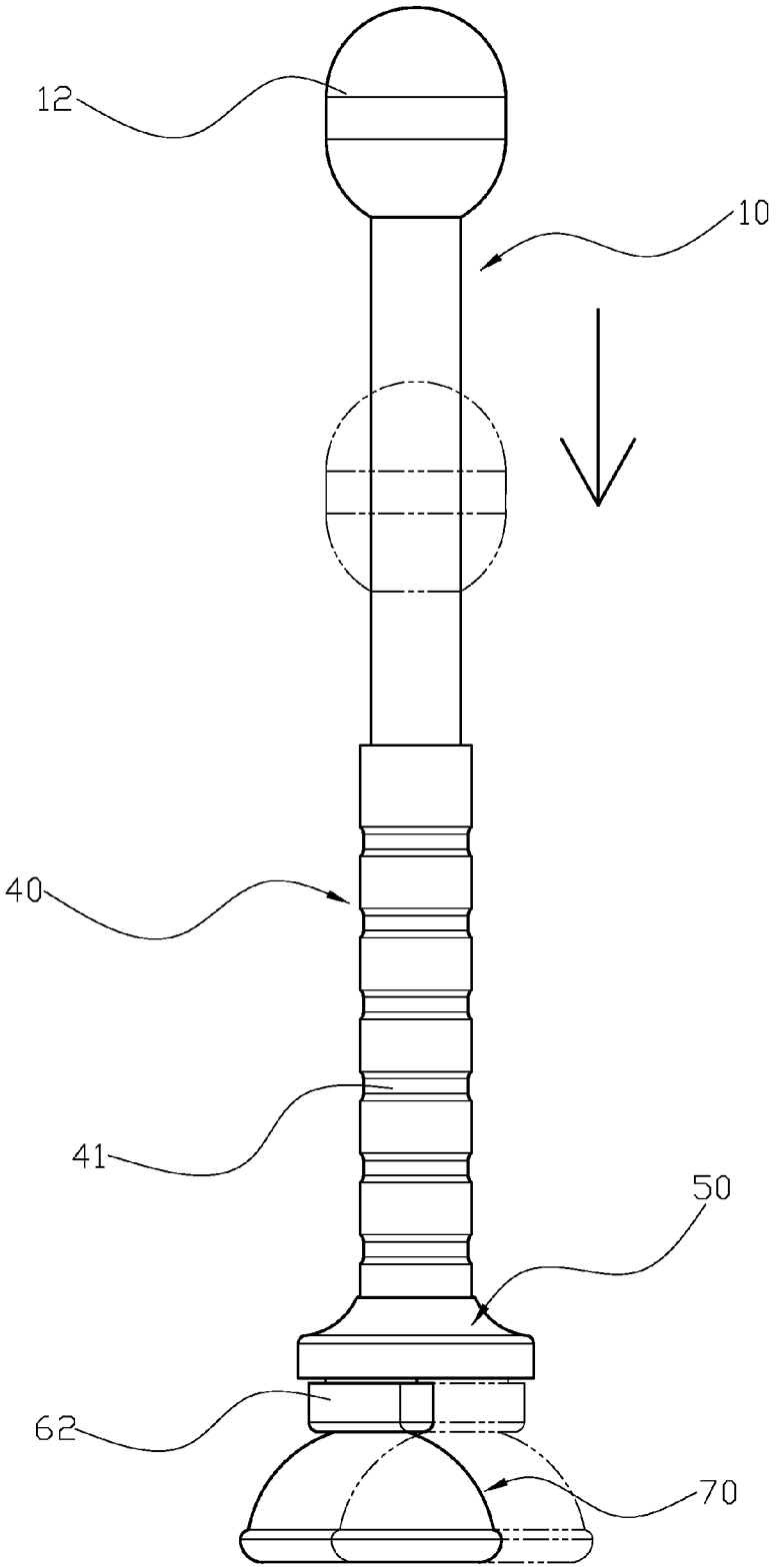
FIG. 7 is a schematic drawing of a massage member performing eccentric rotations according to the preferred embodiment of the present invention.
Figure 8:
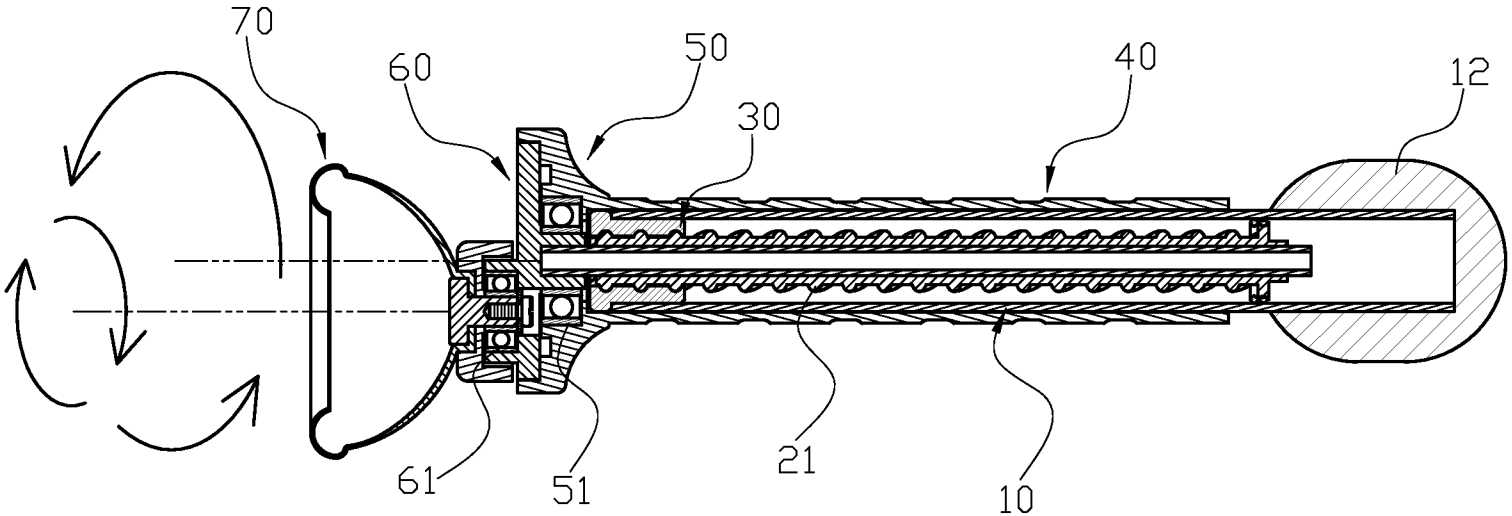
FIG. 8 is a cross-sectional drawing of the massage member performing eccentric rotations according to the preferred embodiment of the present invention.
Figure 9:
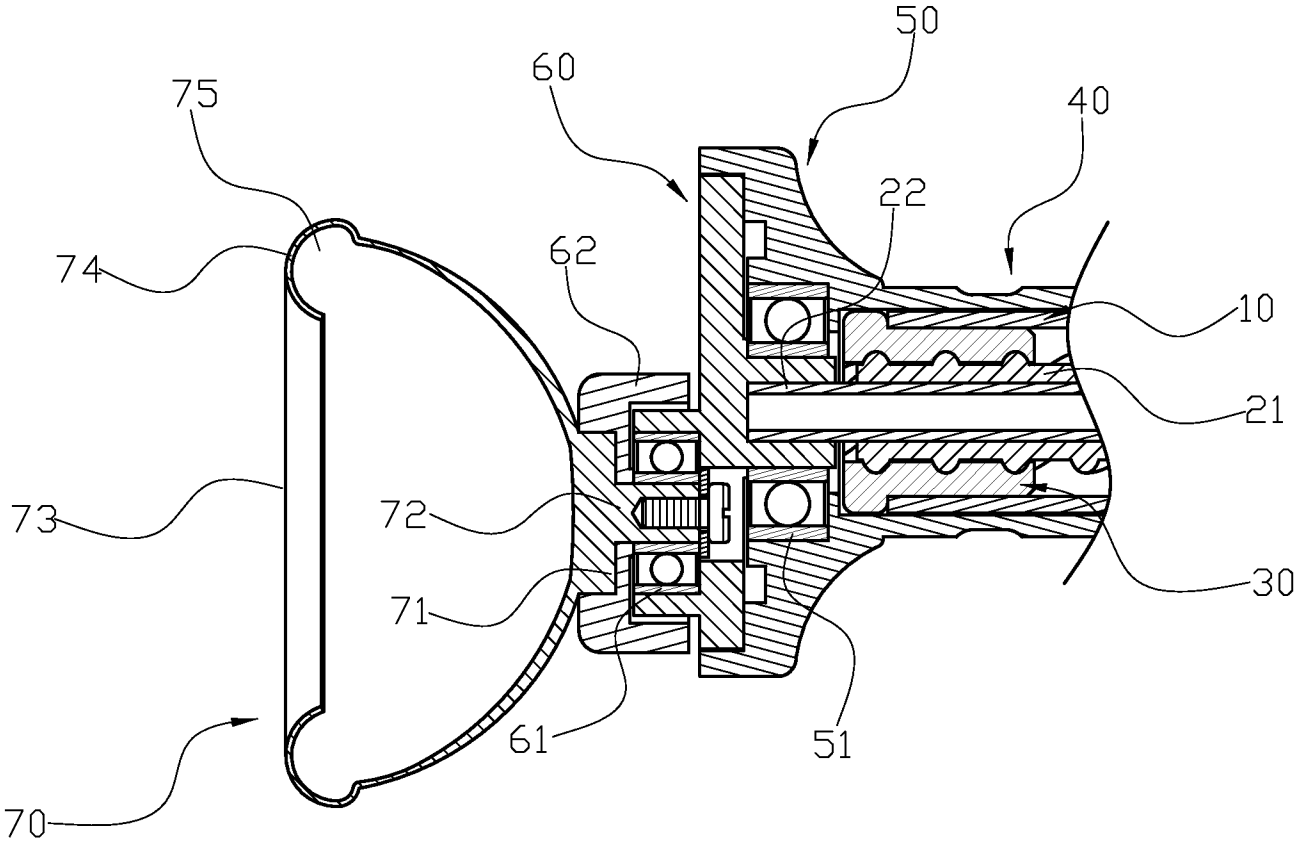
FIG. 9 is a detailed cross-sectional drawing of another embodiment of the present invention.

Please refer to FIG. 6, FIG. 7 and FIG. 8. For actual use, the user places the massage member 70 on a body area, so this area has contact with the flange 73, and with different application forces, the flange 73 can be bent due to the predetermined space 75 to make the massage surface 74 to have complete surface contact with the body area which prevents uncomfortable liner contact. The user holds the gripping section 40 with one hand and pushes the enlarged end 12 with another hand to push in or pull away the control handle 10 repeatedly. Consequently, the second engaging member 30 moves along the control handle 10, with the second engaging member 30 and the screw rod 21, the horizontal force is converted into a rotational force for the rotation disk 60, such that the massage member 70 generates eccentric rotations and the reverse force generated by the rotations is counteracted by the rotations generated by the first bearing 51 and the second bearing 61. Meanwhile, the massage member 70 generates a slow pressing massage force to the body area instead of a direct beating force. Furthermore, since the massage member 70 only provides a gentle massage to the surface of the skin, this massage device is also suitable for the head area or the facial area, and the movements of the hands also serve as hand exercises for the user.

In addition, a buffer ring 23 is placed around the raised edge of the first engaging member 20, to prevent noise caused by the collision between the second engaging member 30 and the raised edge 212 while the control handle 10 moves to a maximum travel distance.

With the above-mentioned structure, the following benefits can be obtained: 1. The massage device requires no electricity and has a convenient size, which is highly portable for the user. 2. The massage device only affects the surface of the skin, which can avoid causing any damage or injury to the body, and the material of the massage member 70 is suitable for use on the facial area or the area of the head or any other fragile area of the human body. 3. The movements of the hands also serves as hand exercises for the user. 4. Since the massage member 70 is made of silicon, the massage surface 74 can have a complete contact surface with the skin of the body area, which can prevent painful feelings caused by the liner contact. 5. The massage device provides a large contact surface, which can improve the massage effect.

Although the present invention has been explained in relation to its preferred embodiment, it is to be understood that many other possible modifications and variations can be made without departing from the spirit and scope of the invention as hereinafter claimed.

What is claimed is:

1. A hand-held massage device comprising: a control handle, a first engaging member, an second engaging member, a gripping section, a casing, a rotation disk and a massage member; wherein the control handle is an extended hollow rod providing a containment space for the first engaging member, one end of the control handle having an enlarged portion and another end capable of accepting the second engaging member;

the first engaging member has a screw rod and has a spiral slot around a periphery of the screw rod and a sleeve respectively extending from both ends;

the second engaging member has a threaded hole with a spiral slot, the threaded hole engaging with the screw rod of the first engaging member when the second engaging member is secured onto the control handle;

the gripping section is a hollow tube and has an inner diameter substantially equal to an outer diameter of the control handle and the second engaging member, such that the control handle is capable of being disposed in the gripping section and sliding inside of the gripping section;

the casing is installed onto another end of the gripping section opposite the end accepting the control handle, and has a first bearing containment space for accepting a first bearing at a central position on a front side, the first bearing containment space having a through aperture for allowing the sleeve of the first engaging member to be connected to the rotation disk;

the rotation disk has a socket at a central position on a side for accepting and securing the sleeve, a second bearing containment space formed at an eccentric position on another side, and after a second bearing is placed in the second bearing containment space, a cover is placed to close the space, and the second bearing containment space further has a through hole; and the massage member is cup-shaped, a raised portion is formed at a central position of an end, the raised portion further having a securing knob placed through the cover and screwed with a corresponding screw at an end adjacent to the through hole, such that the raised portion of the massage member is secured onto the cover;

wherein a flange is inwardly formed at an open end of the massage member, the flange providing a curved and smooth massage surface and a predetermined space is formed between the massage surface and a bottom of the massage member.

2. The hand-held massage device as claimed in claim 1, wherein a rear end of the control handle is installed with a detachable enlarged end.

3. The hand-held massage device as claimed in claim 1, wherein the screw rod of the first engaging member is made of plastic, the sleeve is made of metal, and the screw rod is formed by injection on the sleeves.

4. The hand-hold massage device as claimed in claim 1, wherein a raised edge is formed at a rear end of the screw rod, the raised edge jacketed with a ring; wherein when the rear end of the first engaging member is placed into the control handle, the raised edge and the ring both push against an inner wall of the containment space for supporting.

5. The hand-hold massage device as claimed in claim 4, wherein the screw rod further has a buffer ring placed around the raised edge.

6. The hand-hold massage device as claimed in claim 1, wherein the second engaging member and the control handle are formed separately or integrally.

7. The hand-hold massage device as claimed in claim 1, wherein the gripping section further has a plurality of anti-slip slots, and the gripping section and the casing are formed separately or integrally.

8. The hand-hold massage device as claimed in claim 1, wherein the securing knob and the massage member are formed separately or integrally.

9. The hand-hold massage device as claimed in claim 1, wherein the massage member is made of silicon material.

* * * * *